United States Patent [19]

Coster

[11] Patent Number: 4,740,188

[45] Date of Patent: Apr. 26, 1988

[54] TOY CONSTRUCTION ELEMENT

[76] Inventor: Theo M. S. Coster, Beyt Horon St., 7, Tel Baruch, Tel Aviv, Israel

[21] Appl. No.: 891,512

[22] Filed: Jul. 31, 1986

[51] Int. Cl.[4] ..... A63H 33/08

[52] U.S. Cl. ..... 446/114; 446/106; 446/125

[58] Field of Search ..... 446/114, 106, 107, 108, 446/110, 113, 115, 124, 125

[56] References Cited

U.S. PATENT DOCUMENTS

| | | | |
|---|---|---|---|
| 2,712,200 | 7/1955 | Dearling | 446/106 X |
| 3,199,246 | 8/1965 | Fischer | 446/108 |
| 3,699,709 | 10/1972 | Schmidt | 446/114 X |
| 3,748,778 | 7/1973 | Ellies et al. | 446/106 |
| 3,790,175 | 2/1974 | Ragnow | 446/115 X |
| 3,838,535 | 10/1974 | Larws | 446/124 |
| 3,882,630 | 5/1975 | Bianco | 446/106 |

FOREIGN PATENT DOCUMENTS

| | | | |
|---|---|---|---|
| 907326 | 8/1972 | Canada | 446/114 |
| 207086 | 2/1909 | Fed. Rep. of Germany | 446/125 |
| 1207290 | 9/1970 | United Kingdom | 446/125 |
| 1401801 | 7/1975 | United Kingdom | 446/113 |

*Primary Examiner*—Robert A. Hafer
*Assistant Examiner*—D. N. Muir
*Attorney, Agent, or Firm*—Townsend & Townsend

[57] ABSTRACT

An elongate rectangular bar useful as a toy construction element and including one or more apertures and one or more pairs of transversely aligned notches. Each aperture has a generally non-circular configuration and defines top bottom and intermediate portions each having a constant width.

9 Claims, 4 Drawing Sheets

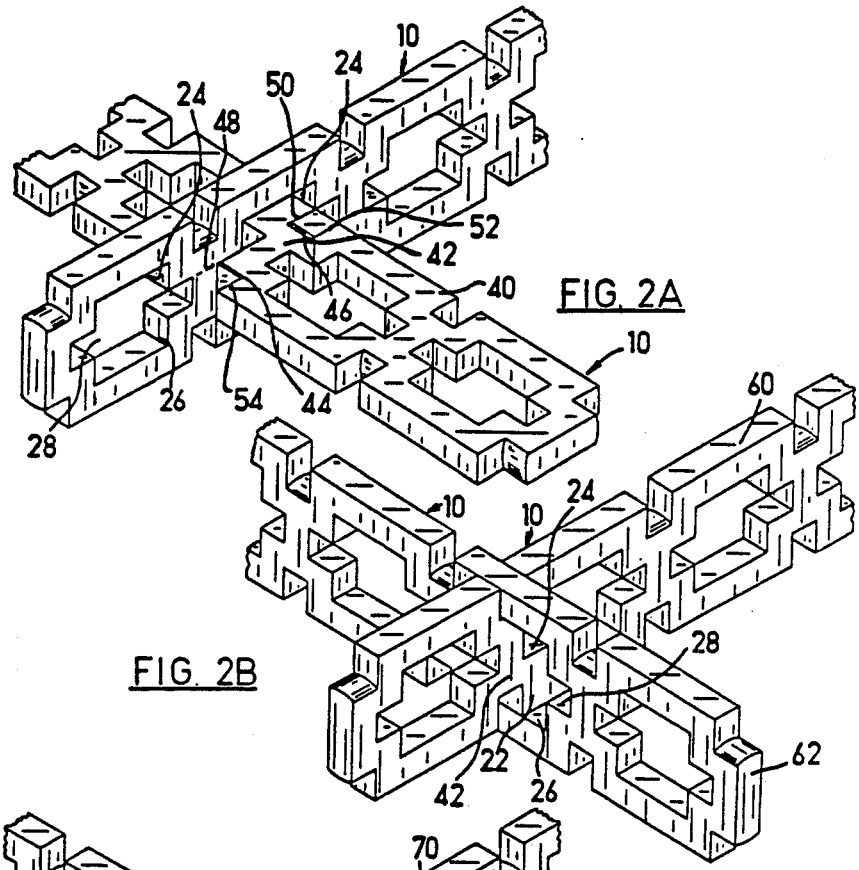
FIG. 2A
FIG. 2B
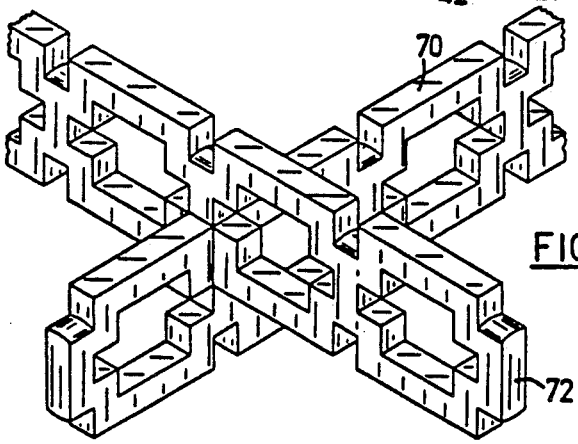
FIG. 2C

TOY CONSTRUCTION ELEMENT

FIELD OF THE INVENTION

The present invention relates to toy construction elements generally and more particularly to an elongated, apertured rectangular bar of a substantially uniform thickness.

BACKGROUND OF THE INVENTION

Elongated apertured rectangular bars of substantially uniform thickness useful as toy construction elements are well known, having been popularized and sold by the billions by Borden, Inc., the assignee of applicant's U.S. Pat. No. 3,633,717.

The bars were sold as sticks for frozen confectionary and were used thereafter for interlocking construction in various constructions, with certain limitations. One important limitation was that only a single bar could be inserted through a given aperture at one time.

SUMMARY OF THE INVENTION

The present invention seeks to provide elongated apertured rectangular bars of substantially uniform thickness useful as toy construction elements having features which are not present in the existing bars of this type, which features enable an enhanced range of construction possibilities to be realized.

There is thus provided in accordance with a preferred embodiment of the present invention an elongated rectangular bar of substantially uniform thickness useful as a toy construction element, each bar comprising at least one aperture and a pair of transversely aligned notches, and defining a first width at all locations therealong except at the transversely aligned notches and a second width, less than the first width at the locations of the transversely aligned notches, the aperture having a generally non-circular configuration and defining top, bottom and intermediate portions, the intermediate portion of the aperture having a width no less than the first width and the top and bottom portions each having a width less than the first width but greater than the second width.

In accordance with a preferred embodiment of the present invention, the longitudinal dimension between the outer edges of the transversely aligned notches are substantially equal to the thickness of the bar but with sufficient tolerance to insure a force fit of a pair of perpendicularly oriented bars at the transversely aligned notches.

Further in accordance with a preferred embodiment of the present invention, the dimensions of each of the top, bottom and intermediate portions perpendicular to their widths and their thickness is substantially equal to the thickness of the bar but with sufficient tolerance to permit three suitably oriented parallel arranged bars to be intersectingly engaged at a given aperture.

Additionally in accordance with a preferred embodiment of the present invention there is provided a product comprising a frozen comestible and a rectangular bar of the construction described hereinabove.

BRIEF DESCRIPTION OF THE DRAWINGS

The present invention will be understood and appreciated more fully from the following detailed description taken in conjunction with the drawings in which:

FIGS. 2A, 2B, 2C, 2D, 2E and 2F are illustrations of various intersection configurations of the bars of FIG. 1.

DETAILED DESCRIPTION OF A PREFERRED EMBODIMENT

Figure 1A:
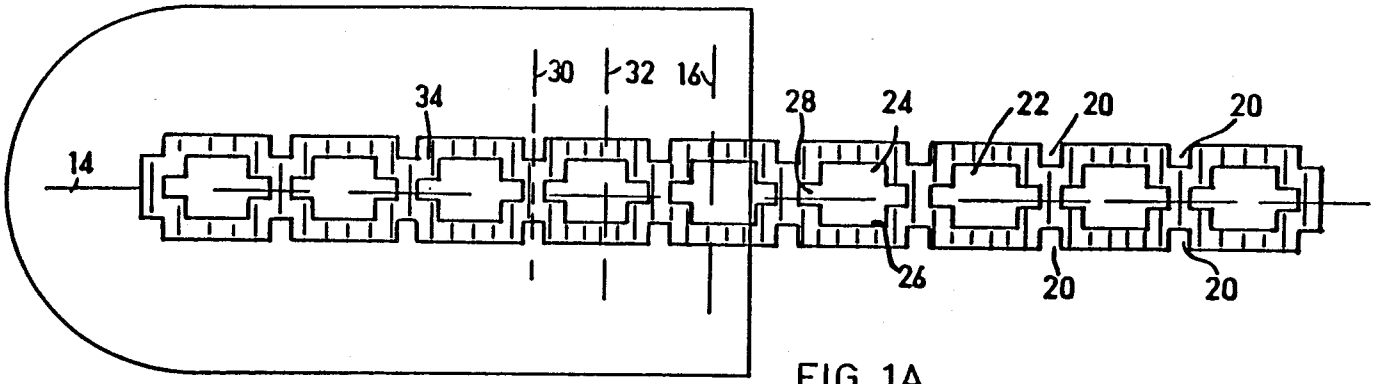
FIGS. 1A and 1B are respective plan and side view illustrations of a bar constructed and operative in accordance with a preferred embodiment of the present invention.
Figure 1B:
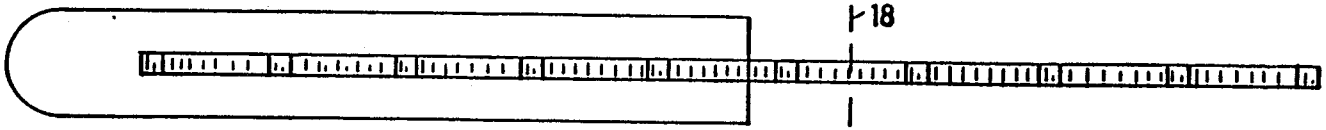

Reference is now made to FIGS. 1A and 1B, which illustrate a bar 10 constructed and operative in accordance with a preferred embodiment of the present invention, disposed in a supporting relationship to an element of frozen confectionary 12, such as an ice cream treat.

It is to be appreciated that although the bar 10 is here presented in the context of a support stick for frozen confectionary, the present invention is not limited to that context. Accordingly the bar of the present invention need not be used as a support stick and may, indeed, be constructed with dimensions more than an order of magnitude bigger than would be appropriate for a support stick application. The present invention is directed to a bar useful for any toy constructional application and of any suitable size.

Bar 10 is typically formed of solid or hollow plastic material, such as high impact polystyrene or structural polypropylene foam and has the overall configurations of a longitudinal strip extending along a longitudinal axis 14 and being of uniform width and thickness along respective mutually perpendicular axes 16 and 18. At substantially regular intervals it is formed with a pair of transversely aligned notches 20, typically of generally uniform dimensions along axis 14 and depth along an axis parallel to axis 16.

According to a preferred embodiment of the present invention, the dimensions of notches 20 are substantially equal to the thickness of the bar 10 so as to permit a friction fit engagement therebetween, when two or more bars 10 are joined in a perpendicular arrangement as will be described hereinbelow. Notches 20 are also provided at the two ends of bar 10.

Intermediate pairs of transversely aligned notches 20, there are formed in bar 10, apertures 22 which are of distinct non-circular configuration and which may be considered to include three portions, top and bottom portions 24 and 26 and an intermediate portion 28, each of a width along an axis parallel to axis 16 substantially equal to the thickness of the bar 10 so as to permit a friction fit engagement with three parallel disposed bars, when they are joined thereto in a perpendicular arrangement.

Top and bottom portions 24 and 26 are each typically of a length along axis 14 which is substantially equal to the width of the bar 10 along an axis 30 parallel to axis 16 at the location of paired transversely aligned notches 20 so as to permit a friction fit engagement therebetween, when two or more bars 10 are joined in a perpendicular arrangement as will be described hereinbelow.

Intermediate portion 28 typically has a length along axis 14 which is substantially equal to the width of bar 10 along an axis 32 parallel to axis 16 at locations intermediate the location of paired transversely aligned notches 20 so as to permit a friction fit engagement therebetween, when two or more bars 10 are joined in a perpendicular arrangement as will be described hereinbelow.

It is noted that bar 10, when notches 20 and apertures 22 are considered, may be envisioned as being defined by an outline 34 of generally uniform dimensions and of generally square cross section.

Figure 2D:
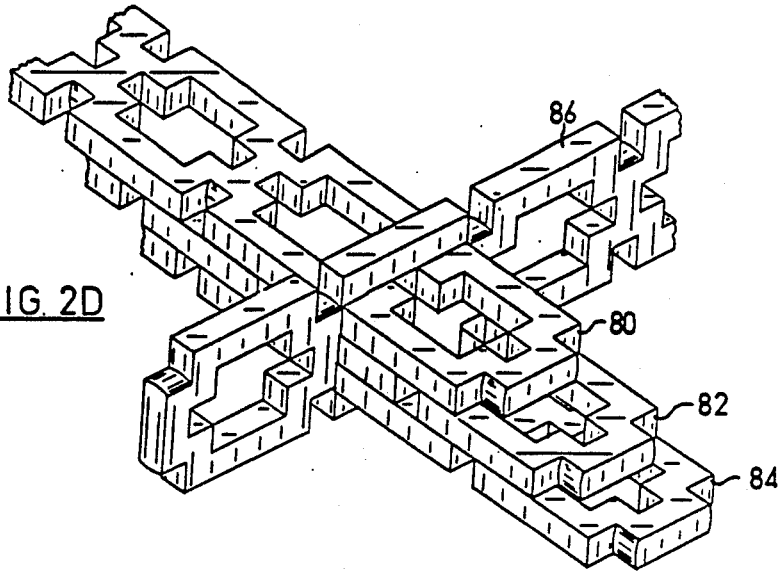

The constructional versatility of bar 10 will now be demonstrated with reference to FIGS. 2A–2F. FIG. 2A illustrates a pair of intersecting bars 10 wherein a bar 40 is disposed with a portion 42 thereof between the pair of transversely aligned notches 20, located in a bottom portion 26 of an aperture 22. It is noted that a friction fit is provided along six separate pairs of engaging surfaces, 44, 46, 48, 50, 52 and 54.

FIG. 2B illustrates another arrangement of intersecting bars 10 wherein a bar 60 is disposed with a portion 42 thereof disposed across top, bottom and intermediate portions 24, 26 and 28 to one side of an aperture 22 of a perpendicularly disposed bar 62. It may be appreciated that up to three bars 60 may be disposed in parallel, longitudinally aligned arrangement with respect to bar 62 in engagement with aperture 22.

FIG. 2C illustrates notch-to-notch engagement of two perpendicularly disposed bars 70 and 72. Here no aperture engagement is provided. Nevertheless, it will be noted that a friction fit is provided along six separate pairs of engaging surfaces.

FIG. 2D illustrates the engagement of three parallel disposed, longitudinally offset bars 80, 82 and 84 in respective top, intermediate and bottom portions 24, 28 and 26 of an aperture 22 in a perpendicuarly disposed bar 86. A friction fit is provided along six separate pairs of engaging surfaces for each bar as well as between bars 80 and 82 and 82 and 84. An extremely strong construction is thus provided.

Figure 2E:
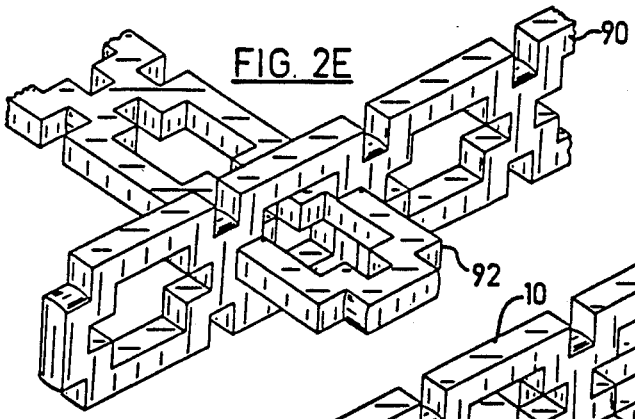
Figure 2F:
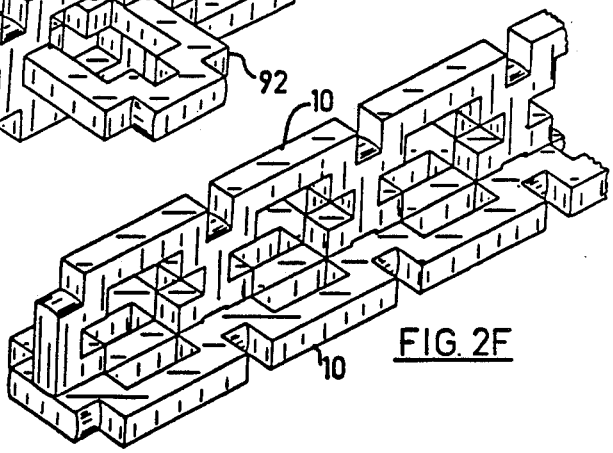

FIG. 2E illustrates the engagement of a bar 90 at a location intermediate transversely aligned notches 20 with the intermediate poriton 28 of aperture 22 of a perpendicularly disposed bar 92. FIG. 2F illustrates edge to aperture engagement of two bars 10 whose longitudinal axes 14 are parallel but whose perpendicular axes 16 are perpendicular.

Figure 3:
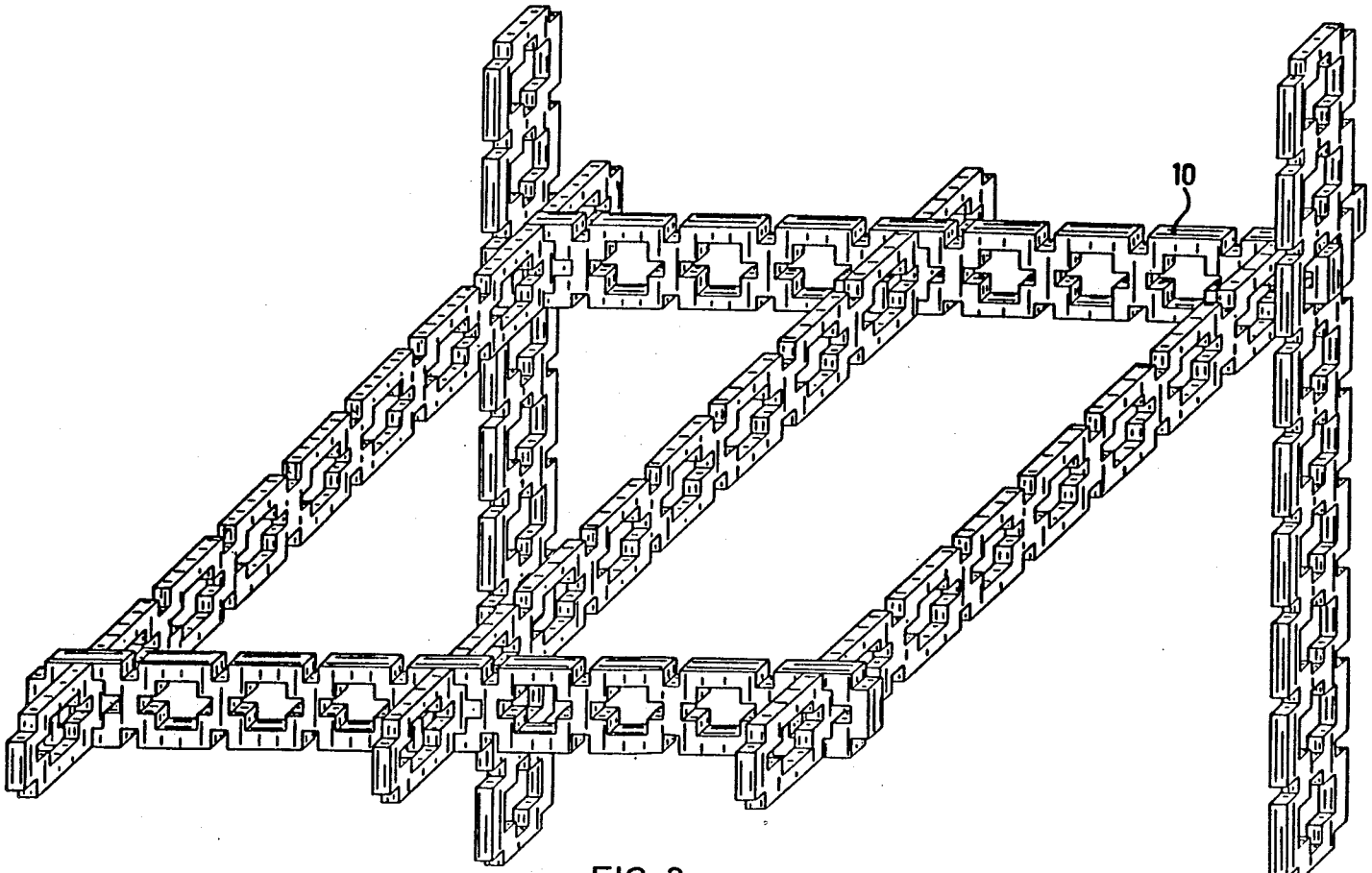
FIG. 3 is a pictorial illustration of a plurality of bars used as playground construction elements.

FIG. 3 is a pictorial illustration of the use of bars 10 as playground construction elements.

It will be appreciated by persons skilled in the art that the present invention is not limited by what has been particularly shown and described hereinabove. Rather the scope of the present invention is defined only by the claims which follow:

I claim:

1. An elongated rectangular bar of substantially uniform thickness useful as a toy construction element, each bar comprising at least one aperture and a pair of transversely aligned notches, and defining a first width at all locations therealong except at the transversely aligned notches and a second width, less than the first width at the locations of the transversely aligned notches, the aperture having a generally non-circular configuration and defining top, bottom and intermediate portions, the intermediate portion of the aperture having a width no less than the first width and the top and bottom portions each having a constant width less than the first width but greater than the second width.

2. A bar according to claim 1 and wherein the longitudinal dimension between the outer edges of the transversely aligned notches is substantially equal to the thickness of the bar but with sufficient tolerance to insure a force fit of a pair of perpendicularly oriented bars at the transversely aligned notches.

3. A bar according to claim 1 and wherein the dimensions of each of the top, bottom and intermediate portions perpendicular to their widths and their thickness is substantially equal to the thickness of the bar but with sufficient tolerance to permit three suitably oriented parallel arranged bars to be intersectingly engaged at a given aperture.

4. A bar according to claim 2 and wherein the dimensions of each of the top, bottom and intermediate portions perpendicular to their widths and their thickness is substantially equal to the thickness of the bar but with sufficient tolerance to permit three suitably oriented parallel arranged bars to be intersectingly engaged at a given aperture.

5. A frozen comestible product comprising a frozen comestible and a handle which is formed into a rectangular bar of substantially uniform thickness useful as a toy construction element, each bar comprising at least one aperture and a pair of transversely aligned notches, and defining a first width at all locations therealong except at the transversely aligned notches and a second width, less than the first width at the locations of the transversely aligned notches, the aperture having a generally non-circular configuration and defining top, bottom and intermediate portions, the intermediate portion of the aperture having a width no less than the first width and the top and bottom portions each having a constant width less than the first width but greater than the second width.

6. A frozen comestible product comprising a comestible and a handle which is formed into a rectangular bar according to claim 5 and providing that that distance between sides of any one notch is substantially equal to said uniform thickness providing an interference fit between orthogonal bars where one bar notch is engaging one notch of another bar.

7. A construction toy comprising a plurality of interengageable rectangular bars of substantially uniform thickness useful as a toy construction element, each bar comprising at least one aperture and a pair of transversely aligned notches, and defining a first width at all locations therealong except at the transversely aligned notches and a second width, less than the first width defined as that distance between transversely aligned notches, the aperture having a generally non-circular configuration and defining top, bottom and intermediate portions, the intermediate portion of the aperture having a width no less than the first width and the top and bottom portions each having a constant width approximately that of said second width.

8. A construction toy according to claim 7 wherein said second width is approximately three times greater than said uniform thickness where three bars may be engaged within one said aperture.

9. A construction toy according to claim 7 where that distance defined between said top portion and said bottom portion of said aperture is approximately that of said second width providing an interference fit between the notches of one bar engaging one of said bottom and said top portions of any of said apertures.

* * * * *